US007176608B2

(12) United States Patent
Kanao

(10) Patent No.: US 7,176,608 B2
(45) Date of Patent: Feb. 13, 2007

(54) SPARK PLUG

(75) Inventor: Keiji Kanao, Chita-gun (JP)

(73) Assignee: Denso Corporation, Kariya (JP)

( * ) Notice: Subject to any disclaimer, the term of this patent is extended or adjusted under 35 U.S.C. 154(b) by 168 days.

(21) Appl. No.: 10/964,696

(22) Filed: Oct. 15, 2004

(65) Prior Publication Data

US 2005/0110381 A1 May 26, 2005

(30) Foreign Application Priority Data

Oct. 24, 2003 (JP) ..... 2003-364161

(51) Int. Cl.
*H01T 13/20* (2006.01)

(52) U.S. Cl. ..... 313/141; 313/118

(58) Field of Classification Search ..... 313/118, 313/140, 141, 143

See application file for complete search history.

(56) References Cited

FOREIGN PATENT DOCUMENTS

| | | |
|---|---|---|
| EP | 1139529 A2 | 10/2001 |
| EP | 1168547 A1 | 1/2002 |
| JP | 5-55490 | 7/1993 |

*Primary Examiner*—Joseph Williams
(74) *Attorney, Agent, or Firm*—Nixon & Vanderhye P.C.

(57) ABSTRACT

A spark plug is disclosed as including a metal shell 10 formed with first and second bores 10*c*, 10*d* and a stepped section 10*e* between the first and second bores, and a porcelain insulator 20 having a largest-diameter section 20*d*, which is accommodated in the first bore and a small-diameter section 20*e* accommodated in the second bore. The first and second bores of the metal shell have a dimensional relationship, lying in a value equal to or less than 1.8 mm, which is expressed as (D1−D2)/2 where D1 represents an inner diameter of the first bore of the metal shell and D2 represents an inner diameter of the second bore of the metal shell.

11 Claims, 6 Drawing Sheets

SPARK PLUG

CROSS REFERENCE TO RELATED APPLICATIONS

This application is related to Japanese Patent Application No. 2003-364161 filed on Oct. 24, 2003, the content of which is hereby incorporated by reference.

BACKGROUND OF THE INVENTION

1. Field of the Invention

The present invention relates to spark plugs for internal combustion engines and, more particularly, to a small-sized spark plug having a metal shell formed with a mounting thread of a value less than M10.

2. Description of the Related Art

In general, the related art spark plug is known to include a metal shell formed with a mounting thread to be mounted to an engine, a porcelain insulator fixedly secured to an inside of the metal shell such that one end of the porcelain insulator protrudes from one end of the metal shell, a center electrode fixedly secured to an axial bore of the porcelain insulator such that one end of the center electrode protrudes from the one end of the porcelain insulator, and a ground electrode fixedly secured to the metal shell and having one end placed in a face-to-face relationship with the one end of the center electrode by a spark discharge gap.

Recently, there is an increasing demand to provide an engine with a high power output in which a cylinder body is formed with an intake manifold and an exhaust manifold, associated with intake and exhaust valves formed in enlarged diameters, and a water jacket to provide improvement over delivery of coolant water.

For this reason, a need arises for decreasing an installation space occupied for a spark plug mounted in the engine and ensuring an increased space around a combustion chamber, and to this end, there is an increasing demand for the spark plug to be minimized (in a smaller diameter configuration).

In the related art, for instance, sizes of mounting threads of spark plugs have taken a standard metric thread of M14 on JIS (Japanese Industrial Standard). However, a need arises for providing miniaturized spark plugs each with a mounting thread formed in a smaller diameter less than M10 as disclosed in Japanese Utility Model No. 5-55490.

By the way, because of a demand for high power outputs of the engines described above, the engines have high compression ratios. To satisfy such a demand, the spark plugs are required to operate at increased discharge voltages (demanded voltages) and subjected to severe circumstances in order to ensure a withstand voltage.

Particularly, with an attempt to structure the spark plugs in a narrow diameter configuration as set forth above, the porcelain insulator, electrically insulating the center electrode and the metal shell from one another, results in a reduced wall thickness, causing important issues with an increased probability of decreasing the plug's ability to withstand voltage.

In the related art, dielectric breakdowns occur in the spark plugs in areas where the porcelain insulators and the metal shells are held in engagement and the spark plugs are sufficed to ensure the withstand voltage at those areas. However, due to severe operating circumstances of the engines recently in use, dielectric breakdowns also occur in the spark plugs even at other areas, raising a need to take new counter measure.

SUMMARY OF THE INVENTION

The present invention has been completed with the above view in mind and has an object to provide a spark plug, formed with a mounting thread of a standard metric thread less than M10, which is structured in a small diameter configuration while enabling an appropriate withstand voltage to be ensured.

To achieve the above object, considerable research and development work has been diligently undertaken. In order to ensure the withstand voltage in the spark plug, there are two counter measures: one for increasing a wall thickness of a porcelain insulator, and the other for minimizing field intensity occurring in an area where the metal shell is placed in face-to-face relationship with the porcelain insulator.

The presence of an increase in the wall thickness of the porcelain insulator leads to an increase in a diameter of the spark plug contrary to a need for a small diameter configuration of the spark plug.

Therefore, consideration has been made to minimize the wall thickness of the porcelain insulator for thereby ensuring the withstand voltage of the porcelain insulator with no need to increase the wall thickness of the porcelain insulator. Then, study has been conducted to find which portion of the porcelain insulator is apt to be subjected to dielectric breakdown.

As a result, it has been found that there is a phenomenon where pinholes occur in an area between a middle step section and a waist section of the porcelain insulator, where the wall thickness remarkably changes, with a resultant occurrence of dielectric breakdown. This area is described in detail with reference to a spark plug shown in a cross section in FIG. 7.

With the spark plug shown in FIG. 7, a porcelain insulator 20 is inserted to an inside of a metal shell 10, and a metal shell 10 has an upper end that is caulked at a caulked portion 12 to fixedly retain the porcelain insulator 20. Disposed in a space between the metal shell 10 and a cylindrical section 20*c* of the porcelain insulator 20 are seal members 60, 61 that are fixedly retained in place by the caulked portion 12 to provide a gas-tight sealing effect.

Formed on the porcelain insulator 20 to be continuous with the cylindrical section 20*c* is a waist section 20*d*, with the maximum diameter, whose stepped difference is utilized for accommodating the seal members 60, 61 and enabling the upper end of the metal shell 10 to be caulked at the caulked portion 12. Also formed on the porcelain insulator 20 on a side closer to a spark discharge section (located downward in FIG. 7) to be continuous with the waist section 20*d* is a middle step section 20*e* that has a diameter smaller than that of the waist section 20*d*.

Thus, the porcelain insulator 20 is formed with the waist section 20*d*, for the purposes of realizing the caulking of the metal shell 10 at the caulked portion 12 for fixing the porcelain insulator 20 and locating the seal members 60, 61 within a space between the porcelain insulator 20 and the metal shell 10, and the middle step section 20*e*, extending toward the spark discharge side, which is made smaller in diameter to achieve a small diameter configuration. For this reason, a stepped difference is present between the waist section 20*d* and the middle step section 20*e* of the porcelain insulator 20.

Further, a fine gap exists between an inner wall of the metal shell 10 and the porcelain insulator 20 for insertion of the porcelain insulator 20 and the inner wall of the metal shell 10 has a shape in conformity with an outer profile of the porcelain insulator 20. Therefore, in compliance with a stepped difference between the waist section 20*d* and the middle step section 20*e* of the porcelain insulator 20 set forth above, the area of the metal shell 10 placed in face-to-face relationship with such stepped difference takes a stepped configuration.

A stepped section 10*e* of the metal shell 10 serves as an area, apt to suffer from concentrated electric field, where strongly intensified electric fields appear to cause sparks to occur across the stepped section 10*e* of the metal shell 10 and the opposing stepped section, between the waist section 20*d* and the middle step section 20*e*, of the porcelain insulator 20 to cause pinholes P to occur in the stepped section 20*f* of the porcelain insulator 20 with a resultant occurrence of dielectric breakdown.

Therefore, consideration has been made for it to be effective for the degree of the stepped section 10*e* of the metal shell 10 to be minimized to some extent and experimental studies have been conducted using a stepped difference dimension expressed as (D1−D2)/2 as a parameter of the degree of the stepped section 10*e* of the metal shell 10 where D1 represents an inner diameter of an axial bore 10*c* of the metal shell 10 facing the waist section 20*d* of the porcelain insulator 20 and D2 represents an inner diameter of an axial bore 10*d* of the metal shell 10 that faces the middle step section 20*e* of the porcelain insulator 20.

As a result, it can be confirmed that the smaller the stepped difference dimension in (D1−D2)/2, the less will be the field intensity occurring at the stepped section 10*e* of the metal shell 10 set forth above (see FIG. 4). Thus, the present invention has been created based on such acknowledgements.

According to one aspect of the present invention, there is provided a spark plug which comprises a metal shell formed with a first bore and a second bore, smaller in diameter than the first bore, and an outer periphery formed with a mounting thread. A porcelain insulator is fixedly secured to the metal shell such that one end of the porcelain insulator protrudes from one end of the metal shell and includes a largest-diameter section, which is accommodated in the first bore of the metal shell, and a small-diameter section, having one end extending from the largest-diameter section and the other end closer to the one end of the porcelain insulator, which is accommodated in the second bore of the metal shell. The largest-diameter section and the small-diameter section are opposed through a gap to an inner wall of the metal shell which defines the first and second bores. A center electrode is retained within the porcelain insulator with an end thereof located outside the porcelain insulator. A ground electrode is joined to the metal shell, the ground electrode having a portion facing the end of the center electrode through a spark gap. The metal shell has an inner diameter D1 at a portion of the inner wall to which the largest-diameter portion is opposed through the gap and an inner diameter D2 at a portion of the inner wall to which the small-diameter portion is opposed through the gap, the inner diameters D1 and D2 meeting a relation of (D1−D2)/2 which is less than or equal to 1.8 mm.

Thus, with the structure comprised of the metal shell formed with the first and second bores and the small diameter section between the first and second bores, the porcelain insulator fixedly secured to the metal shell, such that the one end of the porcelain insulator protrudes from the one end of the metal shell, and having the largest-diameter section accommodated in the first bore of the metal shell and the small-diameter section accommodated in the second bore of the metal shell, the center electrode fixedly secured to the inside of the porcelain insulator such that the one end of the center electrode protrudes from the one end of the porcelain insulator, and the ground electrode having one end placed in a face-to-face relationship with the one end of the center electrode with the spark discharge gap, the spark plug has the following features:

(1) The porcelain insulator is formed with the largest diameter section, serving as a waist section, which is accommodated in the first bore of the metal shell, and the small-diameter section, serving as a middle stepped section, which has one end extending from the waist section and the other end closer to the one end of the porcelain insulator.

(2) The waist section and the middle step section of the porcelain insulator are placed in a face-to-face relationship with the first and second bores of the metal shell and spaced therefrom by the first and second gaps, respectively.

(3) The dimensional relationship is expressed as (D1−D2)/2, which has a value equal to or less than 1.8 mm, where D1 represents an inner diameter of the first bore of the metal shell and D2 represents an inner diameter of the second bore of the metal shell.

The present invention has been completed based on experimental tests and the presence of the value equal to or less than 1.8 mm selected for the stepped difference dimension in (D1−D2)/2 enables the spark plug to have an adequate withstand voltage lying in a practical level (see FIG. 5).

Accordingly, the present invention makes it possible to provide a spark plug that is made in a smaller diameter configuration to ensure an appropriate withstand voltage.

In addition, upon experimental studies conducted for the relationship between a size of a gap, between the middle step section of the porcelain insulator and the inner wall of the metal shell, and a field intensity occurring at the stepped section of the metal shell, it has been found that if the size of the gap drops below a certain value, the field intensity rapidly increases (see FIG. 6).

According to another aspect of the present invention, the second bore of the metal shell and the small-diameter section of the porcelain insulator has a dimensional relationship, lying at a value equal to or greater than 0.05 mm and equal to or less than 0.5 mm, which is expressed as:

$$(D2-A2)/2$$

where A2 represents an outer diameter of the small-diameter section of the porcelain insulator.

If the value of the clearance, expressed by (D2−A2)/2, exceeds the value of 0.5 mm, the porcelain insulator tends to have a reduced wall thickness with resultant deterioration in an ability to withstand high voltage and the metal shell tends to have a reduced wall thickness with deterioration in a strength under restrictions where the small diameter configuration is to be achieved.

That is, by selecting the value of the clearance, expressed by (D2−A2)/2, between the middle section of the porcelain insulator and the inner wall of metal shell to the value equal to or greater than 0.05 mm and equal to or less than 0.5 mm, it becomes possible to prevent the field intensity from exceptionally increasing at the small-diameter section of the metal shell, thereby enabling to have an ability to withstand high voltage in a further reliable manner.

According to another aspect of the present invention, there is provided a spark plug wherein the spark discharge gap lies in a value equal to or less than 0.9 mm.

With the spark discharge gap selected to lie in the value equal to or less than 0.9 mm, an increase in the igniting voltage can be suppressed to prevent the small diameter section and the largest-diameter section of the porcelain insulator from being applied with exceptionally high voltage, thereby reliably ensuring the ability to withstand high voltage.

According to another aspect of the present invention, there is provided a spark plug wherein the one end of the center electrode includes a noble metal chip, joined to the one end of the center electrode as a spark discharge member, which has a cross sectional surface area lying at a value equal to or greater than 0.07 $mm^2$ and equal to or less than 0.55 $mm^2$.

For instance, with the spark discharge gap selected to lie in the narrow value equal to or less than 0.9 mm as set forth above, the presence of the narrow noble metal chip fixedly secured to the spark discharge portion of the center electrode adequately enhances an ignition space, resulting in an improved ignitability. Also, it will be appreciated that if the noble metal chip is too narrow, it is too wearable and needs to be formed in a certain size to some extent.

With the above view in mind, the noble metal chip of the center electrode may be preferably defined to have the cross sectional surface area as defined above.

According to another aspect of the present invention, there is provided a spark plug wherein the noble metal chip of the center electrode is made of Ir-alloy containing 50 wt % or more of Ir and at least one additive with a melting point greater than 2000° C.

According to another aspect of the present invention, there is provided a spark plug wherein the additive contained in the noble metal chip of the center electrode includes at least one additive selected from a group consisting of Pt, Rh, Ni, W, Pd, Ru, Re, Al, $Al_2O_3$, Y and $Y_2O_3$.

The inclusion of the material and additive in the noble metal chip of the center electrode adequately ensures an operating life of the noble metal chip of the center electrode.

According to another aspect of the present invention, there is provided a spark plug wherein the ground electrode has one end to which a noble metal chip is joined as a spark discharge member that is placed in face-to-face relationship with the one end of the center electrode. The noble metal chip of the ground electrode has a cross sectional surface area lying at a value equal to or greater than 0.12 $mm^2$ and equal to or less than 0.80 $mm^2$, and the noble metal chip of the ground electrode protrudes in a chip protruding length of a value equal to or greater than 0.3 mm and equal to or less than 1.5 mm.

With such a structure, the provision of the narrow noble metal chip fixedly secured to the spark discharge portion of the ground electrode is effective for an improved ignitability as described above with reference to the noble metal chip of the center electrode.

Considering compatibility between the ignition space to be ensured in the spark discharge portion of the ground electrode and improvement over a wearability of the noble metal chip of the ground electrode, the cross sectional surface area and the chip protruding length of the noble metal chip of the ground electrode are preferably defined in respective values as set forth above.

According to another aspect of the present invention, there is provided a spark plug wherein the noble metal chip of the ground electrode is made of Pt-alloy containing 50 wt % or more of Pt and at least one additive with a melting point greater than 1500° C.

According to another aspect of the present invention, there is provided a spark plug wherein the additive contained in the noble metal chip of the ground electrode includes at least one additive selected from a group consisting of Ir, Rh, Ni, W, Pd, Ru and Re.

With the spark plug having such a noble metal chip, containing the main gradient and additive as defined above, of the ground electrode, an operating life of the noble metal chip of the ground electrode can be adequately ensured.

According to another aspect of the present invention, there is provided a spark plug wherein the mounting thread of the metal shell includes a standard metric thread of a value equal to or less than M10.

With the mounting thread of the metal shell selected to have the value less than M10, a miniaturized spark plug can be provided for use in an internal combustion engine with a high power output.

According to another aspect of the present invention, there is provided a spark plug which comprises a metal shell having a plug mounting external thread of metric M10 or less, the metal shell having a bore formed therein. A porcelain insulator is retained within the bore of the metal shell, the porcelain insulator having a length which includes an end portion, a largest-diameter portion, and a small-diameter portion formed between the largest-diameter portion and the end portion, the end portion protruding outside the bore of the metal shell, the largest-diameter portion and the small-diameter portion being opposed through a gap to an inner wall of the metal shell which defines the bore. A center electrode is retained within the porcelain insulator with an end thereof located outside the porcelain insulator. A ground electrode is joined to the metal shell, the ground electrode having a portion facing the end of the center electrode through a spark gap; a spark discharge gap. The metal shell has an inner diameter D1 at a portion of the inner wall to which the largest-diameter portion is opposed through the gap and an inner diameter D2 at a portion of the inner wall to which the small-diameter portion is opposed through the gap, the inner diameters D1 and D2 meeting a relation of (D1−D2)/2 which is less than or equal to 1.8 mm.

With such a structure, it becomes possible to miniaturized spark plug that has an ability to withstand high voltage with a resultant increase in an operating life.

BRIEF DESCRIPTION OF THE DRAWINGS

For a better understanding of the present invention and to show how the same may be carried into effect, there will now be described by way of example only, specific embodiments according to the present invention with reference to the accompanying drawings, in which.

DETAILED DESCRIPTION OF THE PREFERRED EMBODIMENTS

Hereinafter, a spark plug of an embodiment according to the present invention will be described below with reference to the accompanying drawings.

Figure 1:
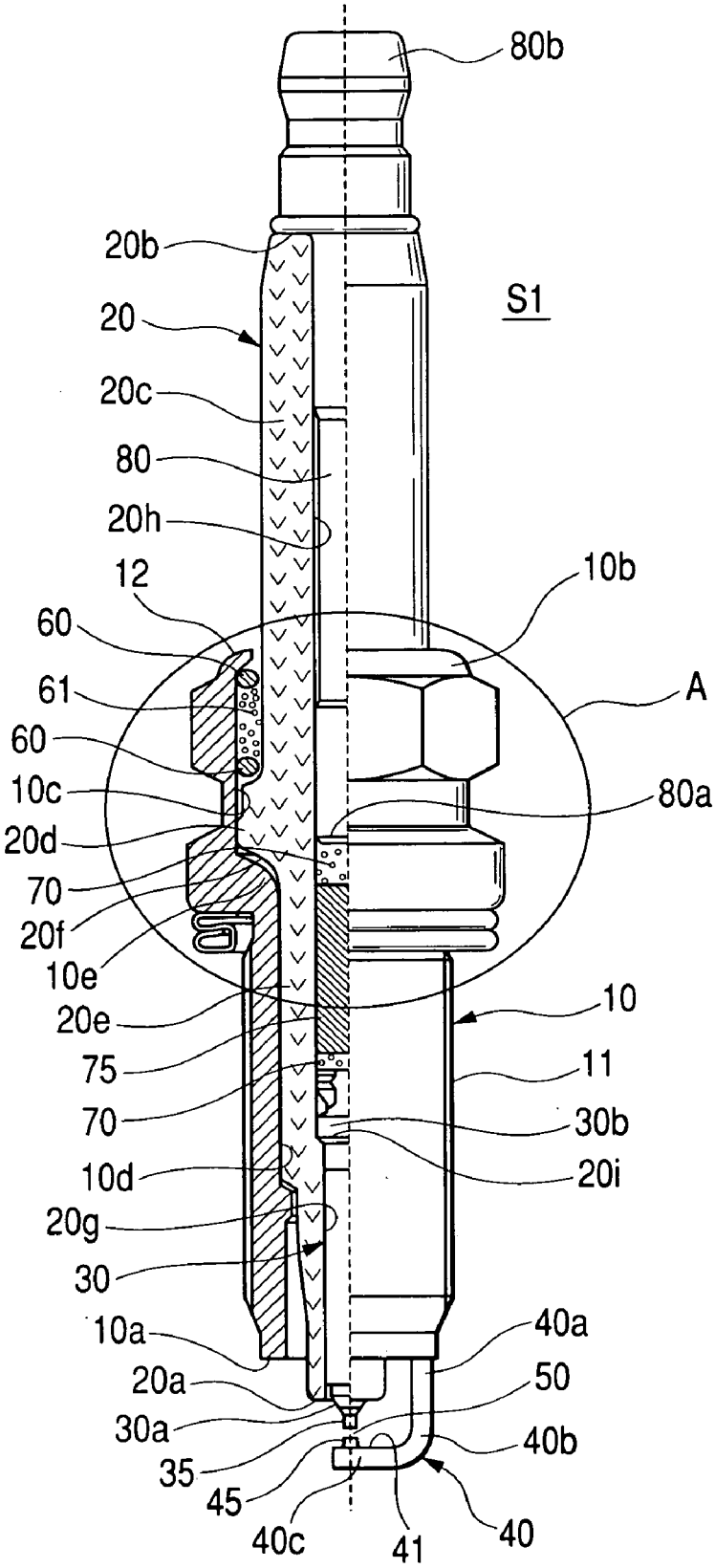
FIG. 1 is a partially cross sectional view showing a spark plug of an embodiment according to the present invention.
Figure 2:
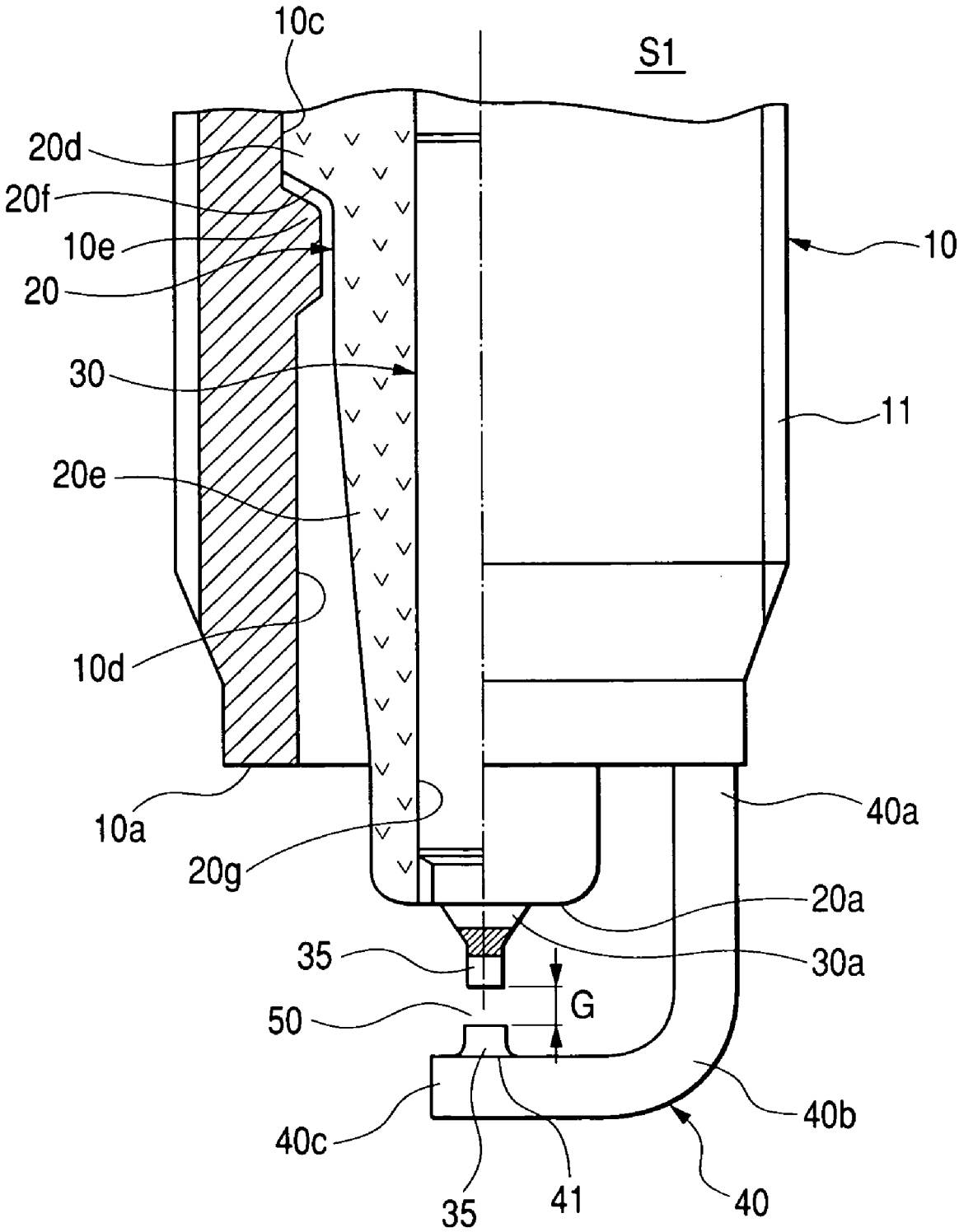
FIG. 2 is an enlarged schematic cross sectional view showing a vicinity of an igniting area of the spark plug shown in FIG. 1.

FIG. 1 is a semi-cross sectional view illustrating an overall structure of a spark plug S1 of an embodiment according to the present invention, and FIG. 2 is a semi-cross sectional view illustrating an enlarged structure of an area in proximity of an igniting section of the spark plug S1.

[Structure of Spark Plug]

The spark plug S1 is used as a spark plug for an automotive engine that includes an engine head (not shown), in which combustion chambers of the engine are defined, which is formed with threaded bores to each of which the spark plug of the presently filed embodiment is screwed in fixed place.

The spark plug S1 includes a cylindrical metal shell 10, made of electrically conductive steel (such as low carbon steel), whose outer circumferential periphery is formed with a mounting thread 11 to be screwed into the engine block (not shown). The mounting thread 11 may preferably have a value equal to or less than a standard metric thread of M10 under JIS (Japanese Industrial Standard).

Accommodated inside the metal shell 10 is a porcelain insulator 20, made of alumina ceramic ($Al_2O_3$), which is fixedly secured to the metal shell 10, and one distal end 20*a* of the porcelain insulator 20 protrudes outward from one distal end 10*a* of the metal shell 10.

Fixedly secured to a first axial bore 20*g* of the insulator 20 is a center electrode 30 that is fixedly held by the metal shell 10 in an electrically insulated state.

The center electrode 30 is comprised of a cylindrical body that is formed of internal material made of metal, such as Cu, excellent in heat conductivity and outer material made of metal, such as Ni-based metal, excellent in heat and corrosion resistances.

As shown in FIG. 1, the center electrode 30 has one distal end 30*a* that protrudes from the distal end 20*a* of the porcelain insulator 20. Thus, the center electrode 30 is fixedly held in the metal shell 10 in an electrically insulated state under a condition where the distal end 20*a* protrudes from the distal end 10*a* of the metal shell 10.

On the other hand, a ground electrode 40 takes the form of a columnar shape that is made of Ni-based alloy with principal component of Ni.

With the presently filed embodiment, the ground electrode 40 takes the form of a rectangular columnar configuration. More particularly, the ground electrode 40 of the presently filed embodiment has one distal end 40*a* fixedly secured to the distal end 10*a* of the metal shell 10 by welding, a middle portion 40*b* bent in a substantially L-shaped configuration, and the other distal end 40*c* laterally extending from the middle portion 40*b* to allow a side face 41 to be placed in face-to-face relationship with the distal end 30*a* of the center electrode 30 with a spark discharge gap 50.

With the presently filed embodiment, further, a noble metal chip 35, serving as a spark discharge member, is joined to the distal end 30*a* of the center electrode 30 by laser welding or resistance welding.

Furthermore, a noble metal chip 45, serving as another spark discharge member, is joined to the side face 41 of the distal end 40*c* of the ground electrode 40 by laser welding or resistance welding such that the noble metal chip 45 is placed in face-to-face relationship with the noble metal chip 35 of the center electrode 30.

For instance, these noble metal chips 35, 45 are formed in a columnar shape and the spark discharge gap 50 forms an air gap between distal ends of the noble metal chips 35, 45. A value G of the spark discharge gap 50 may preferably fall in a value equal to or less than 0.9 mm.

Moreover, an example of the noble metal chip 35 of the center electrode 30 may preferably have a cross sectional surface area, i.e., an axis-orthogonal cross sectional area in a range equal to or greater than 0.7 $mm^2$ and equal to or less than 0.5 $mm^2$ In addition, the noble metal chip 35 of the center electrode 30 may preferably be made of Ir-alloy that contains 50 wt % or more of Ir and at least one kind of additive with a melting point greater than 2000° C.

Further, an example of the additive to be contained in the noble metal chip 35 of the center electrode 30 may preferably contain at least one element selected from the group consisting of Pt (white gold or platinum), Rh (rhodium), Ni (nickel), W (tungsten), Pd (palladium), Ru (ruthenium), Re (rhenium), Al (aluminum), $Al_2O_3$ (alumina), Y (yttrium) and $Y_2O_3$ (yttria).

Besides, the noble metal chip 45 of the ground electrode 40 may preferably have a cross sectional surface area, i.e., an axis-orthogonal cross sectional area in a range equal to or greater than 0.12 $mm^2$ and equal to or less than 0.80 $mm^2$ and may protrude in a chip protruding length in a range equal to or greater than 0.3 mm and equal to or less than 1.5 mm. Also, this chip protruding length refers to a length of the noble metal chip 45 in a value starting from the side face 41 of the ground electrode 40 to a distal end of the noble metal chip 40.

Further, the noble metal chip 45 of the ground electrode 40 may be preferably made of Pt-alloy that contains 50 wt % or more of Pt (platinum) and at least one kind of additive with a melting point greater than 1500° C.

Further, an example of the additive to be contained in the noble metal chip 45 of the ground electrode 40 may preferably contain at least one element selected from the group consisting of Ir, Rh, Ni, W, Pd, Ru and Re.

Figure 3:
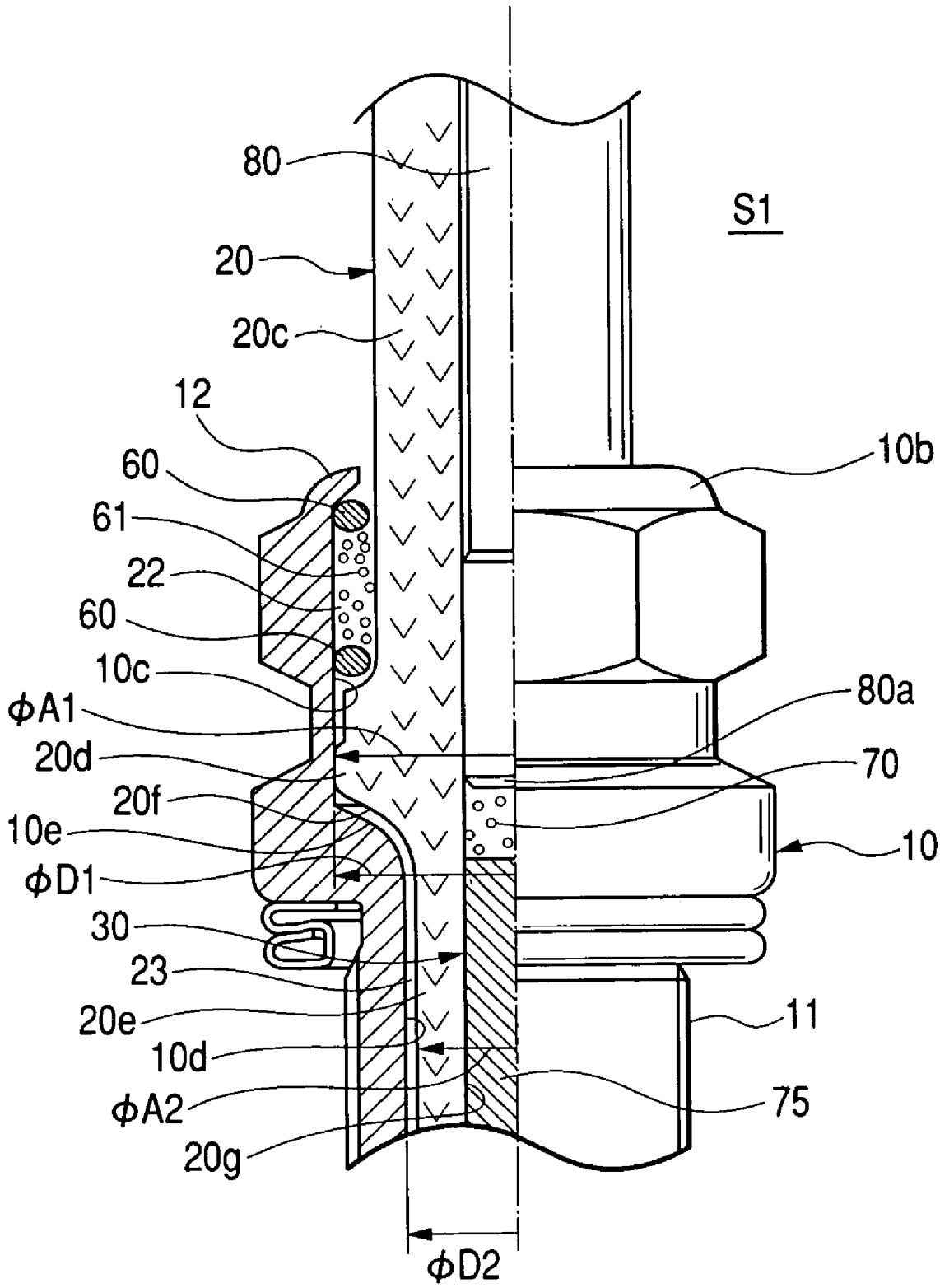
FIG. 3 is an enlarged view showing an area of the spark plug encircled in a circle line A in FIG. 1.

FIG. 3 is an enlarged view of a section encircled in a circle line A in FIG. 1. As shown in FIGS. 1 and 3, the porcelain insulator 20 is inserted through an inside of the metal shell 10. With the metal shell 10 caulked at a caulked portion 12 formed on the distal end 10*b* of the metal shell 10, the porcelain insulator 20 and the metal shell 10 are fixedly retained with respect to one another.

More particularly, defined between an axial bore 10*c* of the metal shell 10 and an upper cylindrical section 20*c* of the porcelain insulator 20 is an annular space 22 in which seal members 60, 61 are filled to gas tightly seal the annular space 22. The seal members 60 include two metal rings 60 disposed in the annular space 22 in spaced relationship between which the seal member 61, formed of talc, is intervened.

Further, as shown in FIGS. 1 and 3, the porcelain insulator 20 includes a waist section 20*d*, continuous with the upper cylindrical section 20*c* and having the maximum outer diameter, which is accommodated in the axial bore 10*c* of the metal shell 10, and a lower cylindrical section 20*e*, serving as a middle step section, which is continuous with the waist section 20*d* through a sloped section 20*f*. Thus, the waist section 20*d* is formed as the maximum diametric portion, which is received in the axial bore 10*c* of the metal shell 10, of the porcelain insulator 20.

The use of such a stepped difference of the waist section 20*d* allows the metal shell 10 to be caulked at the caulked portion 12 and the seal members 60, 61 to be accommodated in the annular space 22 between the axial bore 10*c* of the metal shell 10 and the cylindrical section 20*c* of the porcelain insulator 20.

In addition, as described above, the porcelain insulator 20 has the middle step section 20*e* extending in a length between the waist section 20*d* and the distal end 20*a* of the porcelain insulator 20 and accommodated in an axial bore 10*d* of the metal shell 10. The middle step section 20*e* is made smaller in diameter than the waist section 20*d* to form a stepped differential profile therebetween.

Thus, the porcelain insulator 20 is formed with the stepped section 7 20*d* for the purposes of caulking the metal shell 10 at the caulked portion 12 and permitting the seals 60, 61 to be accommodated in the annular space 22 between the axial bore 10*c* of the metal shell 10. Additionally, as noted above, the porcelain insulator 20 is formed with the reduced diametric middle step section 20*e* in an area closer to the distal end 20*a*, i.e., a spark discharge side, of the porcelain insulator 20 to achieve a small diametric configuration.

Here, the waist section 20*d*, the sloped section 20*f* and the middle step section 20*e* of the porcelain insulator 20 are disposed in an inner wall of the metal shell 10 in a spaced relationship with a gap. This gap (clearance) is provided for easing the insertion of the porcelain insulator 20 into the inner wall of the metal shell 10.

With the inner wall of the metal shell 10 configured in a shape corresponding to an outer profile of the porcelain insulator 20, the metal shell 10 has a stepped differential profile at the stepped section 10*e* in correspondence to the stepped differential profile between the waist section 20*d* and the middle step section 20*e* of the porcelain insulator 20.

The stepped section 10*e* of the metal shell 10 forms an area where an electric field is apt to concentrate. In this respect, it is conceived that with the related art spark plug, an intensive electric field occurs on this stepped section 10*e* to cause spark discharge to occur across the stepped section 10*e* of the metal shell 10 and the sloped section 20*f* of the porcelain insulator 20 placed in face-to-face relationship with the stepped section 10*e* of the metal shell 10, resulting in the formation of pinholes P in the sloped section 20*f* (see FIG. 7), causing dielectric breakdown to occur in the sloped section 20*f*.

To address such an issue, the presently filed embodiment contemplates to decrease the degree of the stepped difference in the metal shell 10 to some extent and defines dimensional relationships as described below.

As shown in FIG. 3, suppose that the axial bore 10*c* of the metal shell 10, with which the associated waist section 20*d* of the porcelain insulator 20 is placed in a face-to-face relationship with the gap, has an inner diameter D1 and the axial bore 10*d* of the metal shell 10, with which the middle step section 20*e* of the porcelain insulator 20 is placed in face-to-face relationship with an annular gap 23, has an inner diameter D2. Then, a stepped difference dimension (dimensional relationship), serving as a parameter of the degree of the stepped difference between the axial bore 10*c* and the axial bore 10*d* of the metal shell 10, is expressed as (D1−D2)/2 that may preferably fall in a value equal to or less than 1.8 mm.

As shown in FIG. 3, further, with the presently filed embodiment, suppose that the middle step section 20*e* of the porcelain insulator 20 has an outer diameter of A2. Then, a value of the clearance between the axial bore 10*d* of the metal shell 10 and the middle step section 20*e* of the porcelain insulator 20 is expressed as (D2−A2)/2. The value of (D2−A2)/2 may preferably fall in a value equal to or greater than 0.05 mm and equal to or less than 0.5 mm.

Moreover, as shown in FIG. 3, with the presently filed embodiment, suppose that the waist section 20*d* of the porcelain insulator 20 has a diameter of A1, a clearance between the waist section 20*d* of the porcelain insulator 20 and the axial bore 10*c* of the metal shell 10 is expressed as (D1−A1)/2.

A value of the clearance in (D1−A1)/2 may be preferably selected to lie in a value approximately equal to or greater than 0.05 mm and equal to or less than 0.5 mm. Also, the diameter Al of the waist section 20*d* of the porcelain insulator 20 represents the outermost periphery of the porcelain insulator 20 in an area accommodated in the metal shell 10.

Turning again to FIG. 1, the porcelain insulator 20 has an axial bore 20*g*, an axial bore 20*h* that has a diameter slightly larger than the axial bore 20*g*, and an annular shoulder 20*i* formed between the axial bores 20*g*, 20*h*.

As shown in FIG. 1, the center electrode 30 is disposed in the axial bore 20*g* of the porcelain insulator 20 and has a top end 30*b* disposed in the axial bore 20*h* of the porcelain insulator 20. The top end 30*b* of the center electrode 30 rests on the annular shoulder 20*i* of the porcelain insulator 20 and electrically connected to a resistor 75 through an electrically conductive glass seal 70 filled in the axial bore 20*h* of the porcelain insulator 20.

Further, as shown in FIG. 1, a terminal electrode 80 is disposed in the axial bore 20*h* of the porcelain insulator 20 and has a first end 80*a* electrically connected to the resistor 75 through the electrically conductive glass seal 70 inside the axial bore 20*h* of the porcelain insulator 20. The terminal electrode 80 has a second end 80*b* that protrudes from the other end 20*b* of the porcelain insulator 20 to be exposed to an outside. An ignition coil (not shown) is adapted to be mounted to the second end 80*b* of the terminal electrode 80.

Furthermore, as shown in FIG. 1, a major portion of the cylindrical section 20*c* of the porcelain insulator 20, except for a minor portion covered with the metal shell 10, extends from the other end 10*b* of the metal shell 10 to form an exposed section. With the presently filed embodiment, the exposed section of the porcelain insulator 20 may preferably have an axial length lying in a value equal to or greater than 15 mm and equal to or less than 25 mm.

[Grounds for Dimensions to be Specified]

Now, description is made of grounds for dimensional relationships specified in the spark plug of the presently filed embodiment wherein the dimensional relationship, expressed as (D1−D2)/2, is preferably determined to fall in the value equal to or less than 1.8 mm and the clearance in (D2−A2)/2 is preferably determined to fall in the value equal to or greater than 0.05 mm and equal to or less than 0.5 mm. These dimensional relationships come out from results obtained on experimental studies conducted by the present inventor in a manner set forth below.

It is to be appreciated here that although the following studying examples were conducted on the spark plug whose mounting thread 11 was a standard metric thread of M10 under JIS, other spark plugs, whose mounting threads 11 have the standard metric thread less than M10, also have a similar tendency to follow the results of the studied examples.

First, spark plugs were manufactured as comparative test pieces in a structure with dimensions A1, A2, D1, D2, shown in FIG. 3, specified in respective values as described below.

The diameter A1 (ϕ A1) of the waist section 20*d* of each porcelain insulator 20 was 12.8 mm, the inner peripheral diameter D1 (ϕ D1) of the axial bore 10*c* of each metal shell 10, facing the waist section 20*d*, 13.1 mm, and the inner peripheral diameter D2 (ϕ D2) of the axial bore 10*d* of each metal shell 10, facing the middle step section 20*e*, 6.6 mm. With the above dimensions specified, the stepped difference in (D1−D2)/2 had a value of 3.25 mm.

Further, with such comparative examples, both a value of clearance in (D1−A1)/2, between the waist section 20*d* of each porcelain insulator 20 and the axial bore 10*c* of each metal shell 10, and a value of clearance in (D2−A2)/2, between the middle step section 20*e* of each porcelain insulator 20 and the axial bore 10*d* of each metal shell 10, were specified to a value of 0.15.

Figure 7:
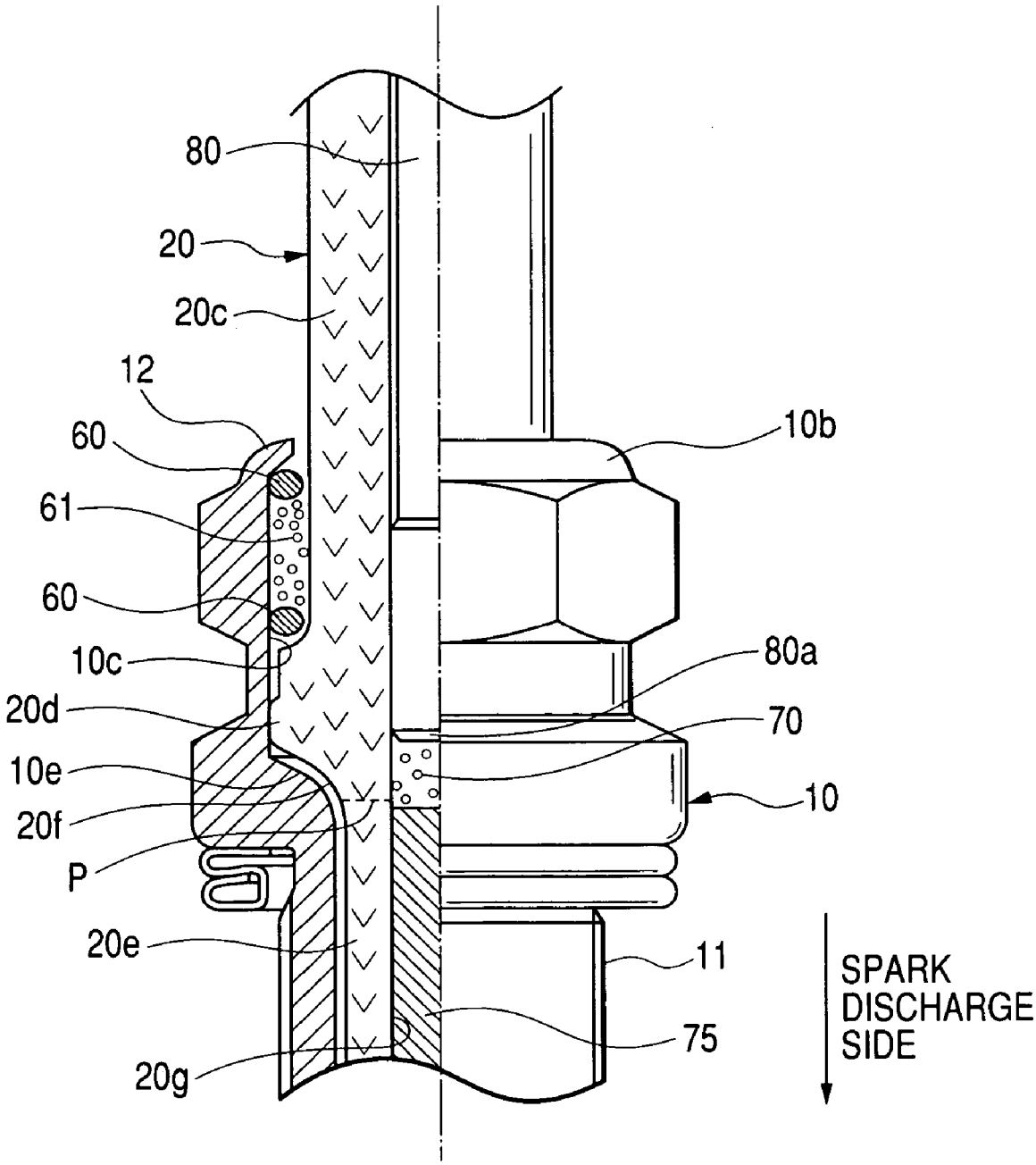
FIG. 7 is a partially cross sectional view illustrating how dielectric breakdown occurs in the porcelain insulator.

Then, withstand voltage test evaluations were conducted on the porcelain insulators 20 of the spark plugs for the above comparative test pieces. A target value was intended not to cause the pinholes P, as shown in FIG. 7, to occur at the sloped section 20*f* of each porcelain insulator 20 even when a voltage of 30 kV was applied across the center electrode 30 and the ground electrode 40.

The value of 30 kV is a value that lies at a sufficiently high withstand voltage on a practical level and it can be said that the spark plug, with no occurrence of dielectric breakdown at the applied voltage of 30 kV, is enhanced to have a sufficient withstand voltage from a practical point of view.

Withstand voltage evaluations were conducted on 20 pieces of spark plugs of the comparative test pieces and among these, two pieces of the spark plugs were found with the occurrence of dielectric breakdown at the applied voltage below 30 kV with a resultant difficulty in achieving the target. That is, with the spark plugs of these comparative examples, difficulties were encountered in ensuring an appropriate withstand voltage.

Here, observations were made on the porcelain insulators 20 of the spark plugs with the occurrence of dielectric breakdown, and it was revealed that the pinholes P actually occurred at the sloped section 20*f*, facing the stepped section 10*e* of the metal shell 10, between the middle step section 20*e* and the waist section 20*d* of the porcelain insulator 20.

Then, analysis on field intensity was conducted using an FEM (Finite Element Method) analysis and it has been proven that a strong field intensity is present in the metal shell 10 at the stepped section 10*e* of the metal shell 10 facing the stepped section 20*f* of the porcelain insulator 20.

That is, as set forth above, it is considered that due to the strong field intensity generated at the stepped section 10*e* of the metal shell 10 where the electric field is apt to concentrate, spark discharge occurs across the stepped section 10*e* of the metal shell 10 and the sloped section 20*f* of the porcelain insulator 20 to create the pinholes P therein with a resultant occurrence of dielectric breakdown.

In view of the above, the present inventor had a consideration in that in order to have improved effects, it is preferable for the degree of the stepped difference, between the axial bore 10*c* (in diameter D1) and the axial bore 10*d* (in diameter D2) of the metal shell 10, to be decreased to some extent. With such a view in mind, experimental studies were conducted on the spark plugs using the stepped difference dimension in (D1−D2)/2 as a parameter for the degree of the stepped difference in the metal shell 10.

First, the FEM (Finite Element Method) analysis was conducted on the spark plugs to find variations in field intensity with the stepped difference dimension in (D1−D2)/2 being varied. During analyses, the inner peripheral diameter D2 of the axial bore 10*d*, facing the middle step section 20*e* of the porcelain insulator 20, of the metal shell 10 was fixed whereas the inner peripheral diameter D1 of the axial bore 10*c*, facing the waist section 20*d* of the porcelain insulator 20, of the metal shell 10 was varied.

Here, the diameter A1 of the waist section 20*d* of the porcelain insulator 20, the diameter A2 of the middle step section 20*e* and a value of the clearance in (D1−A1)/2 and (D2−A2)/2 were specified to have the same values as those of the comparative examples mentioned above.

More particularly, the inner peripheral diameter D2 of the axial bore 10*d* of the metal shell 10, facing the middle step section 20*e* of the porcelain insulator 20, was fixed to a value of 6.6 mm, whereas the inner peripheral diameter D1 of the axial bore 10*c* of the metal shell 10, facing the waist section 20*d* of the porcelain insulator 20, was varied in values of 13.1 mm, 12 mm, 11 mm, 10.5 mm, 10 mm and 9.5 mm to adjust values of the stepped difference dimension in (D1−D2)/2.

Figure 4:
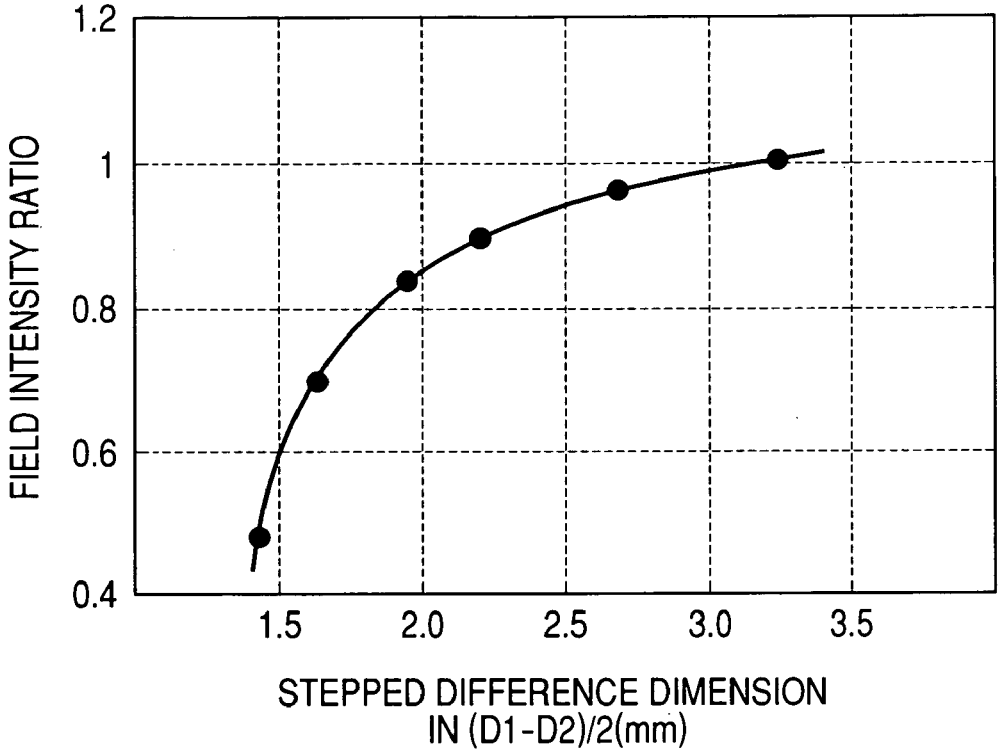
FIG. 4 is a graph illustrating results of an FEM analysis conducted for the relationship between a stepped difference dimension in (D1−D2)/2 and a field intensity.

FIG. 4 is a graph illustrating results of the FEM analyses conducted on the relationship between the stepped difference dimension in (D1−D2)/2 (in unit: mm) and field intensity ratio. Here, the term "field intensity ratio" refers to the field intensity, which would occur at the stepped section 10*e* of the metal shell 10, representing a value of "1" that is standardized on ((D−D2)/2 =3.25 mm) for the comparative examples set forth above.

From the results shown in the graph of FIG. 4, it was revealed that as the stepped difference dimension in (D1−D2)/2 decreases, the field intensity occurring at the stepped section 10*e* of the metal shell 10 decreases.

In consideration of the results shown in FIG. 4, prototypes of test samples were actually fabricated with a fixed value in the inner peripheral diameter D2 of the axial bore 10*d* of the metal shell 10 set forth above whereas the inner peripheral diameter D1 of the axial bore 10*c* of the metal shell 10 was altered in various values, and withstand voltage evaluations were conducted on the porcelain insulators 20 of the prototype samples. Each of values on the stepped difference dimension in (D1−D2)/2 was evaluated with the number of "n" in a value of 20.

Figure 5:
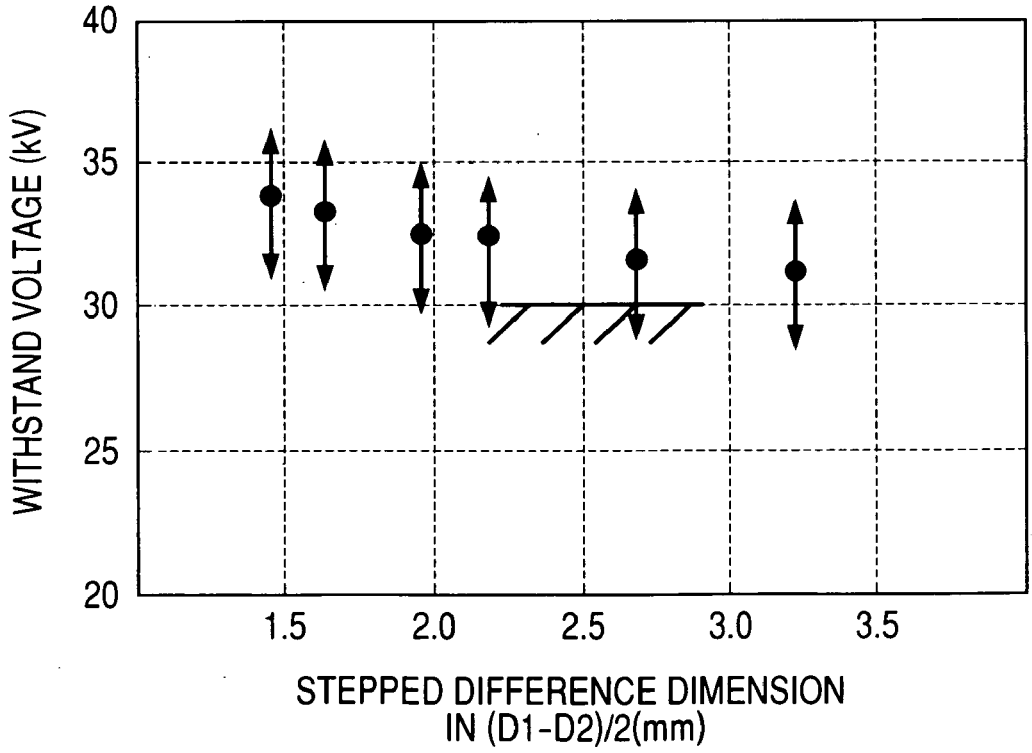
FIG. 5 is a graph illustrating results of an FEM analysis conducted for the relationship between a stepped difference dimension in (D1−D2)/2 and a withstand voltage.

FIG. 5 is a graph illustrating experimental results on the relationship between the stepped difference dimension in (D1−D2)/2 (in unit: mm) and a withstand voltage (in unit: kV).

The results shown in the graph of FIG. 5 have revealed that if the stepped difference dimension in (D1−D2)/2 is less than a value of 1.8 mm, no dielectric breakdown occurs in the porcelain insulator 20 even when a voltage, less than 30 kV, is applied across the metal shell 10 and the porcelain insulator 20. That is, with a value of the stepped difference dimension of (D1−D2)/2 specified to the value equal to or less than 1.8 mm, the withstand voltage of the porcelain insulator 20 exceeds a value of 30 kV and it becomes possible to realize a spark plug that has a sufficient withstand voltage on a practical level.

From the studying results shown in FIGS. 4 and 5, the spark plug of the presently filed embodiment specifies the dimensional relationship, expressed as (D1−D2)/2, to lie in a value less than 1.8 mm. Also, depending on the results shown in the graph of FIG. 5, more preferably, the spark plug of the presently filed embodiment has a value equal to or less than 1.7 mm.

Further, with the FEM analysis conducted on the test pieces, it has revealed that the field intensity occurring at the stepped section 10*e* of the metal shell 10 is also influenced by a clearance, represented by (D2−A2)/2, between the axial bore 10*d* of the metal shell 10 and the middle step section 20*e* of the porcelain insulator 20.

Figure 6:
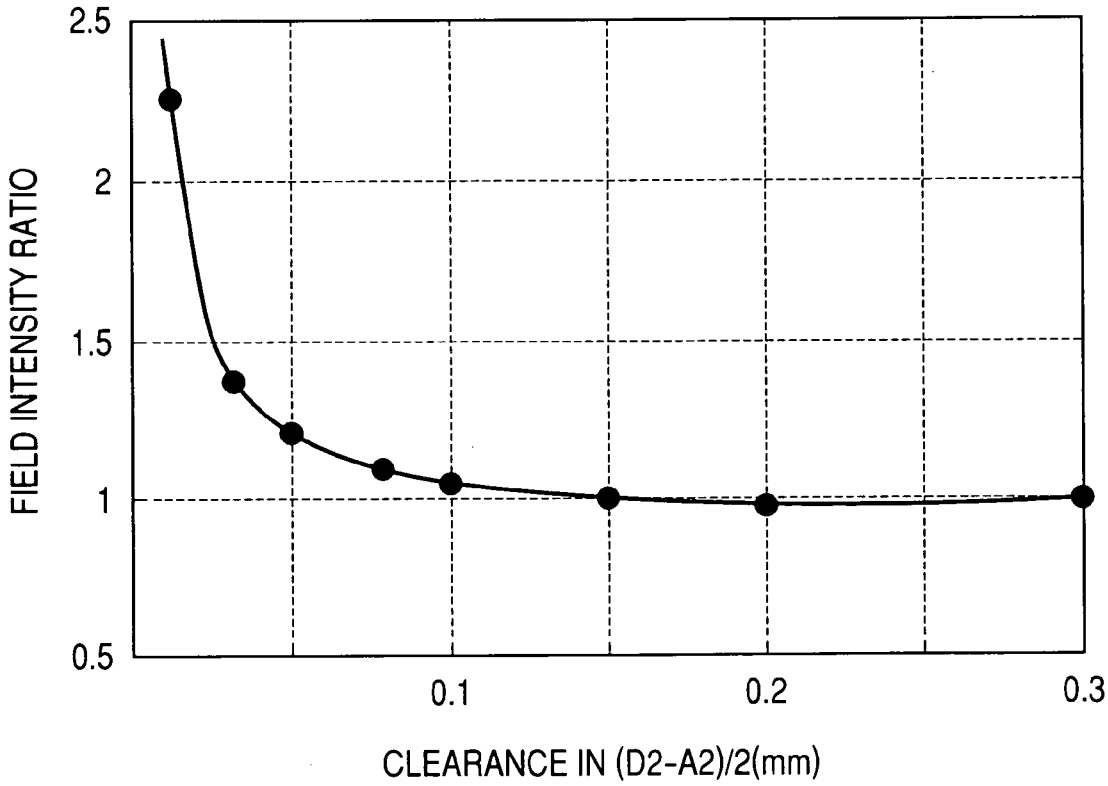
FIG. 6 is a graph illustrating results of an FEM analysis conducted for the relationship between a value of (D1−D2)/2, in a clearance between a middle step section of a porcelain insulator and an inner wall of a metal shell, and a field intensity ratio.

FIG. 6 is a graph illustrating results, based on the FEM analysis conducted on the test pieces in terms of the relationship between a clearance, represented by (D2−A2)/2 (in unit: mm), between the middle step section 20*e* of the porcelain insulator 20 and the axial bore 10*d* of the metal shell 10 and a field intensity ratio. Here, the term "field intensity ratio" is meant the standard value representing the field intensity occurring at the stepped section 10*e* of the metal shell 10 like in the graph of FIG. 4.

From the results shown in FIG. 6, it appears that the smaller the value in clearance in (D2−A2)/2, the stronger will be the field intensity occurring at the stepped section 10*e* of the metal shell 10 and with the clearance having a value less than 0.05 mm, a rapid increase results in the field intensity ratio. Also, with an increase in a value of clearance in (D2−A2)/2, the field intensity decreases and even if the clearance exceeds a value of 0.3 mm, there is not much reduction in the field intensity.

In addition, if a value of clearance in (D2−A2)/2 increases in excess, probabilities occur of a drop in its ability to withstand high voltage, due to a thin-walled configuration resulted in the porcelain insulator 20, or reduction in strength (in the form of a twisted-off thread) caused in a thin-wall configuration of the metal shell 10 under restrictions where the spark plug needs to enhance a small diameter configuration. Consequently, the value of clearance in (D2−A2)/2 may preferably fall in a value up to 0.5 mm.

From the studying results shown in the graph of FIG. 6, with the spark plug of the presently filed embodiment, the clearance size of (D2−A2)/2, between the middle step section 20*e* of the porcelain insulator 20 and the axial bore 10*d* of the metal shell 10, may preferably fall in a value equal to or greater than 0.05 mm and equal to or less than 0.5 mm.

[Features]

As set forth above, with the presently filed embodiment, the spark plug S1 has a main feature in that a parameter of the degree of the stepped difference of the metal shell 10, expressed as (D1−D2)/2, falls in a value equal to or less than 1.8 mm where D1 is the inner peripheral diameter of the axial bore 10*c* of the metal shell 10, with which the waist section 20*d* of the porcelain insulator 20 is placed in face-to-face relationship, and D2 is the inner peripheral diameter of the axial bore 10*d* of the metal shell 10, with which the middle step section 20*e*, smaller in diameter than the waist section 20*d*, of the porcelain insulator 20 is placed in a face-to-face relationship.

With such a feature, as discussed above, it becomes possible to realize a spark plug, having a sufficient withstand voltage on a practical level.

That is, with the presently filed embodiment, the spark plug S1, formed in a small diameter configuration with the mounting thread 11 scaled in a standard metric thread less than M10, can be ensured to have an appropriate withstand voltage.

Additionally, the spark plug S1 of the presently filed embodiment has another feature in that the clearance in (D2−A2)/2, between the middle step section 20*e* of the porcelain insulator 20 and the axial bore 10*d* of the metal shell 10, falls in a value equal to or greater than 0.05 mm and equal to or less than 0.5 mm where A2 is the diameter of the middle step section 20*e* of the porcelain insulator 20.

With such a feature, an exceptional increase in the field intensity, which would result from the stepped difference of the metal shell 10, can be reliably avoided, thereby enabling the porcelain insulator 20 to have a withstand voltage in a further reliable manner.

Further, as set forth above, the spark plug of the presently filed embodiment contemplates to provide the spark discharge gap 50 in a size G preferably lying in a value equal to or less than 0.9 mm. With such a factor, an increase in an igniting voltage can be avoided and the middle step section 20*e* and the waist section 20*d* of the porcelain insulator 20 can be reliably prevented from an exceptionally increased voltage, thereby enabling the porcelain insulator 20 to ensure a withstand voltage in a further reliable manner.

According to the studies, in respect of the factor mentioned above, conducted by the present inventor, it is found that operating conditions tend to appear where if the size G of the spark discharge gap 50 exceeds a value of 0.9 mm, an igniting voltage (i.e., a spark voltage) exceeds a value of 30 kV indicative of an index of the withstand voltage on a practical level. Consequently, it is preferable for the spark discharge gap 50 to have the size G falling in a value less than 0.9 mm.

Further, with the spark plug of the presently filed embodiment, the noble metal chip 35 is joined to the distal end 30*a* of the center electrode 30 serving as the spark discharge member and the noble metal chip 35 of the center electrode 30 is specified to preferably have a cross sectional surface area in a value equal to or greater than 0.07 $mm^2$ and equal to or less than 0.55 $mm^2$.

For instance, with the spark discharge gap 50 specified in a narrow value less than 0.9 mm, the provision of the narrow noble metal chip 35 located in the spark discharge section of the center electrode 30 enables an igniting space to be adequately enhanced, preferably resulting in improvement over ignitability. Also, if the noble metal chip 35 is too small in diameter, the noble metal chip results in increased wear and, so, the noble metal chip needs to have a certain appropriate size.

With the above view in mind, the spark plug of the presently filed embodiment contemplates that the cross sectional area of the noble metal chip 35 of the center electrode 30 is specified in a manner as set forth above.

Here, the spark plug of the presently filed embodiment contemplates that the noble metal chip 35 of the center electrode 30 may preferably include an Ir-alloy containing 50 wt % or more of Ir and at least one additive with a melting point greater than 2000° C.

Further, an example of the additive to be contained in the noble metal chip 35 of the center electrode 30 may preferably include at least one element selected from the group consisting of Pt, Rh, Ni, W, Pd, Ru, Re, Al, $Al_2O_3$, Y and $Y_2O_3$.

The presence of such components in the noble metal chip 35 and such additives in the noble metal chip 35 of the center electrode 30 enables the noble metal chip 35 of the center electrode 30 to have an adequately increased operative life.

Further, with the spark plug of the presently filed embodiment, the noble metal chip 45 is joined to the side face 41 of the ground electrode 40 as the spark discharge member and preferably has a cross sectional surface area equal to or greater than 0.12 $mm^2$ and equal to or less than 0.80 $mm^2$ while preferably extending in a chip protruding length equal to or greater than 0.3 mm and equal to or less than 1.5 mm .

Even here, for the same reason as that of the noble metal chip 35 that is provided on the center electrode 30 set forth above, the spark discharge section of the ground electrode 40 may preferably include the narrow noble metal chip 45.

In consideration of a compatibility between the ensuring of an igniting space in the spark discharge section of the ground electrode 40 and improvement in expendability of the noble metal chip 45 of the ground electrode 40, the cross sectional surface area of the noble metal chip 45 of the ground electrode 40 and the chip protruding length thereof may preferably have the values specified above.

With the spark plug of the presently filed embodiment, the noble metal chip 45 of the ground electrode 40 may preferably include Pt-alloy with 50 wt % or more of Pt containing at least one element of an additive with a melting point higher than 1500° C.

In addition, the example of the additive to be contained in the noble metal chip 45 of the ground electrode 40 may preferably include at lest one element selected from the group consisting of Ir, Rh, Ni, W, Pd, Ru and Re.

The presence of components contained in the noble metal chip 45 of the ground electrode 40 and the additive contained in the noble metal chip 45 specified in such proportions enables the noble metal chip 45 of the ground electrode 40 to have an adequately elongated life.

(Other Embodiment)

Further, the noble metal chips 35, 45 may not be provided on the center electrode 30 and the ground electrode 40, respectively, as set forth above. That is, an alternative structure may be such that both the one end 30*a* of the center electrode 30 and the end of the side face 41 of the ground electrode 40 may serve as spark discharge elements, respectively.

Moreover, the spark plug of the presently filed embodiment has a principal feature in the dimensional relationship as set forth above and, of course, the spark plug may be suitably modified in other details.

While the specific embodiment of the present invention has been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A spark plug comprising:

a metal shell formed with a first bore and a second bore, smaller in diameter than the first bore, and an outer periphery formed with a mounting thread;

a porcelain insulator fixedly secured to the metal shell such that one end of the porcelain insulator protrudes from one end of the metal shell and including a largest-diameter section, which is accommodated in the first bore of the metal shell, and a small-diameter section, having one end extending from the largest-diameter section and the other end closer to the one end of the porcelain insulator, which is accommodated in the second bore of the metal shell, the largest-diameter section and the small-diameter section being opposed through a gap to an inner wall of the metal shell which defines the first and second bores;

a center electrode retained within the porcelain insulator with an end thereof located outside the porcelain insulator; and a ground electrode joined to the metal shell, the ground electrode having a portion facing the end of the center electrode through a spark gap;

wherein the metal shell having an inner diameter D1 at a portion of the inner wall to which the largest-diameter portion is opposed through the gap and an inner diameter D2 at a portion of the inner wall to which the small-diameter portion is opposed through the gap, the inner diameters D1 and D2 meeting a relation of (D1−D2)/2 which is less than or equal to 1.8 mm.

2. The spark plug according to claim 1, wherein:

the second bore of the metal shell and the small-diameter section of the porcelain insulator have a dimensional relationship, lying at a value equal to or greater than 0.05 mm and equal to or less than 0.5 mm, which is expressed as:

$$(D2-A2)/2$$

where A2 represents an outer diameter of the small-diameter section of the porcelain insulator.

3. The spark plug according to claim 1, wherein:

the spark discharge gap lies in a value equal to or less than 0.9 mm.

4. The spark plug according to claim 1, wherein:

the one end of the center electrode includes a noble metal chip, joined to the one end of the center electrode as a spark discharge member, which has a cross sectional surface area lying at a value equal to or greater than 0.07 $mm^2$ and equal to or less than 0.55 $mm^2$.

5. The spark plug according to claim 1, wherein:

the noble metal chip of the center electrode is made of Ir-alloy containing 50 wt % or more of Ir and at least one additive with a melting point greater than 2000° C.

6. The spark plug according to claim 5, wherein:

the additive contained in the noble metal chip of the center electrode includes at least one additive selected from a group consisting of Pt, Rh, Ni, W, Pd, Ru, Re, Al, $Al_2O_3$, Y and $Y_2O_3$.

7. The spark plug according to claim 1, wherein:

the ground electrode has one end to which a noble metal chip is joined as a spark discharge member that is placed in a face-to-face relationship with the one end of the center electrode; and wherein the noble metal chip of the ground electrode has a cross sectional surface area lying at a value equal to or greater than 0.12 $mm^2$ and equal to or less than 0.80 $mm^2$; and wherein the noble metal chip of the ground electrode protrudes in a chip protruding length of a value equal to or greater than 0.3 mm and equal to or less than 1.5 mm.

8. The spark plug according to claim 7, wherein:

the noble metal chip of the ground electrode is made of Pt-alloy containing 50 wt % or more of Pt and at least one additive with a melting point greater than 1500° C.

9. The spark plug according to claim 8, wherein:

the additive contained in the noble metal chip of the ground electrode includes at least one additive selected from a group consisting of Ir, Rh, Ni, W, Pd, Ru and Re.

10. The spark plug according to claim 1, wherein:

the mounting thread of the metal shell includes a standard metric thread of a value equal to or less than M10.

11. A spark plug comprising:

a metal shell having a plug mounting external thread of metric M10 or less, the metal shell having a bore formed therein;

a porcelain insulator retained within the bore of the metal shell, the porcelain insulator having a length which includes an end portion, a largest-diameter portion, and a small-diameter portion formed between the largest-diameter portion and the end portion, the end portion protruding outside the bore of the metal shell, the largest-diameter portion and the small-diameter portion being opposed through a gap to an inner wall of the metal shell which defines the bore;

a center electrode retained within the porcelain insulator with an end thereof located outside the porcelain insulator; and a ground electrode joined to the metal shell, the ground electrode having a portion facing the end of the center electrode through a spark gap; a spark discharge gap;

wherein the metal shell having an inner diameter D1 at a portion of the inner wall to which the largest-diameter portion is opposed through the gap and an inner diameter D2 at a portion of the inner wall to which the small-diameter portion is opposed through the gap, the inner diameters D1 and D2 meeting a relation of (D1−D2)/2 which is less than or equal to 1.8 mm.

* * * * *